US005915519A

United States Patent [19]

Glaser

[11] Patent Number: 5,915,519

[45] Date of Patent: Jun. 29, 1999

[54] COIN CHUTE

[75] Inventor: Robert L. Glaser, Appleton, Wis.

[73] Assignee: L. M. Becker & Co., Inc., Appleton, Wis.

[21] Appl. No.: 09/104,660

[22] Filed: Jun. 25, 1998

[51] Int. Cl.[6] ..... G07F 1/04

[52] U.S. Cl. ..... 194/345; 194/347

[58] Field of Search ..... 194/345, 321, 194/322, 323, 324, 347

[56] References Cited

U.S. PATENT DOCUMENTS

| | | | |
|---|---|---|---|
| 2,014,505 | 9/1935 | Patche | 194/347 |
| 2,158,919 | 5/1939 | Tratsch et al. | 194/345 |
| 2,181,818 | 9/1939 | Mills | 194/321 |
| 2,226,873 | 12/1940 | Patzer et al. | 194/321 |
| 4,306,644 | 12/1981 | Rockola et al. | 194/1 K |
| 5,441,138 | 8/1995 | Hird et al. | 194/345 |
| 5,596,630 | 1/1997 | Hsu | 194/345 |
| 5,601,177 | 2/1997 | Oden | 194/348 |

*Primary Examiner*—F. J. Bartuska
*Assistant Examiner*—Bryan J. Jaketic
*Attorney, Agent, or Firm*—Quarles & Brady LLP

[57] ABSTRACT

The present invention provides a coin chute for use with a coin changer in a vending machine. There is a coin entry path defined by a ramp mounted adjacent a main plate and a backplate. Upon activation of a coin reject lever accessible by a user, the one plate swings away from the other allowing an object jammed in the coin entry path to fall off of the coin entry path into a coin return chute. A kicker urges objects off of the ramp as the plates swing apart. The ramp is also tilted to allow fluid to drain off of the ramp through a gap between the ramp and a plate.

2 Claims, 2 Drawing Sheets

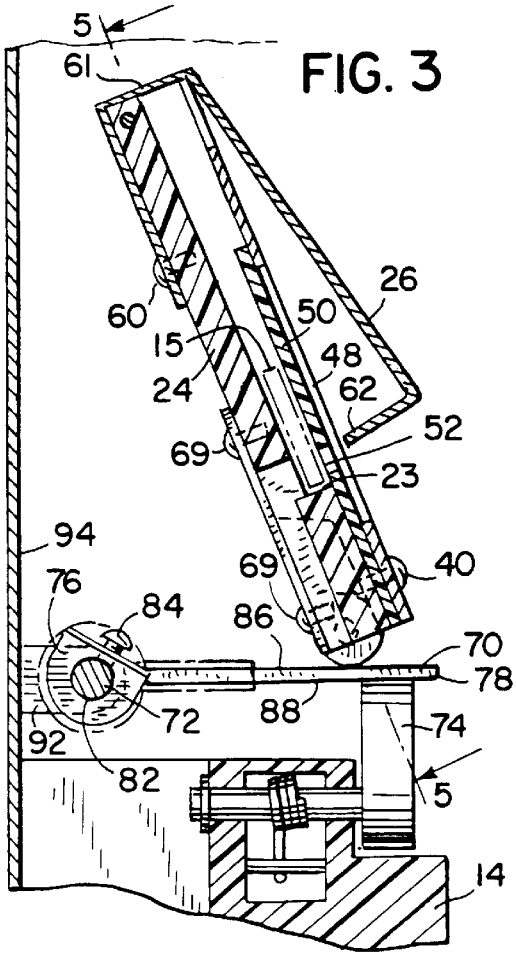
FIG. 3
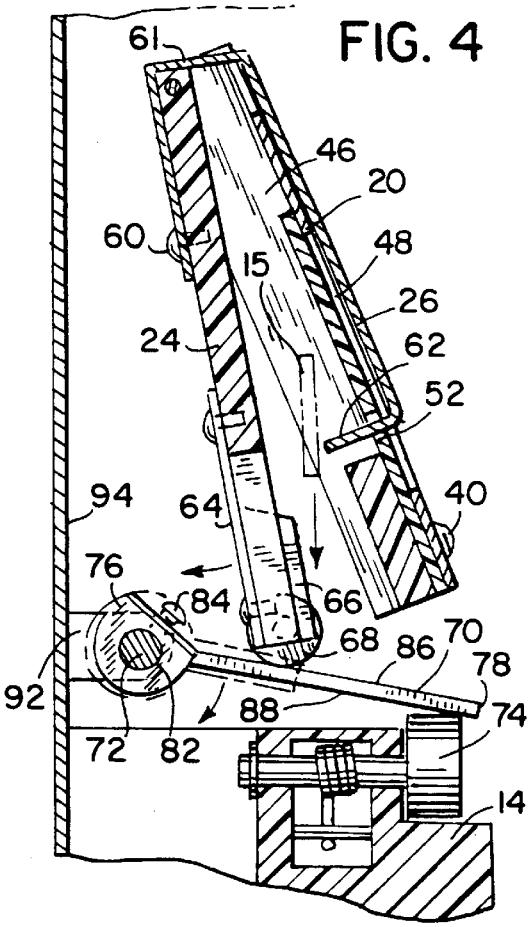
FIG. 4
FIG. 5
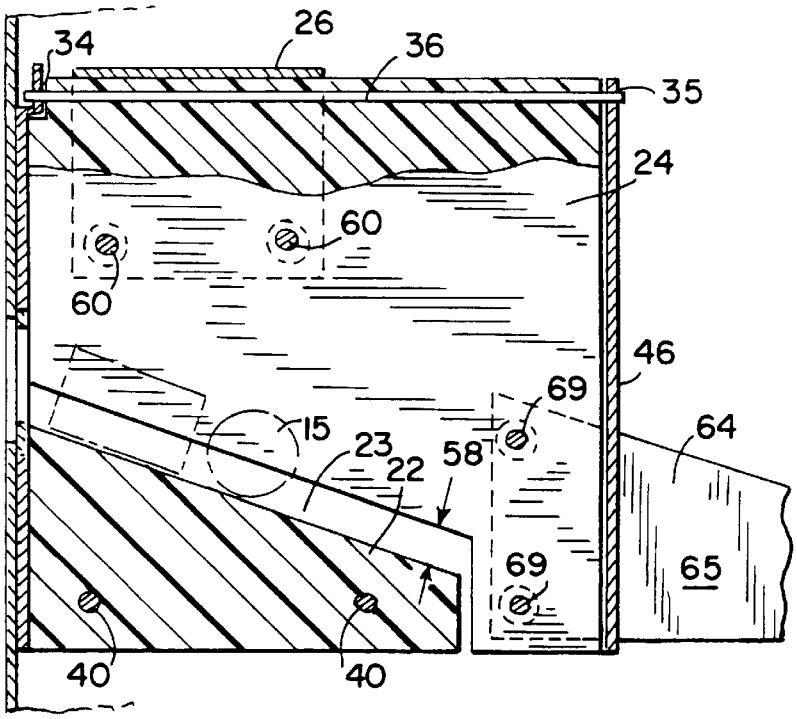

COIN CHUTE

CROSS REFERENCES TO RELATED APPLICATIONS

Not Applicable

STATEMENT REGARDING FEDERALLY SPONSORED RESEARCH

Not Applicable

BACKGROUND OF THE INVENTION

The invention relates to coin chutes for vending machines. More particularly, it provides coin chutes that protect vending machines from objects that are jammed or squirted into a vending machine coin entry slot.

Many vending machines have a coin entry slot for the insertion of coins. Vandals or unscrupulous competitors sometimes attempt to disable vending machines by squirting a fluid or inserting objects other than the correct coins into the coin entry slot. These attempts sometimes take the form of paper clips, paper, or the like which are jammed into the coin entry slot to prevent further use of the vending machine.

U.S. Pat. Nos. 4,306,644 and 5,601,177 disclose chutes that provide some protection, especially against fluids squirted in the coin entry slot of a vending machine. They provided a curvilinear coin chute having an open bottom wall that allows fluid to drain off of the coin entry path prior to reaching the coin changer. However, these chutes still had significant problems clearing solid jams.

As such, it can be seen that a need exists for an improved coin chute.

BRIEF SUMMARY OF THE INVENTION

The present invention provides a coin chute for use with a vending machine. There is a first plate and a second plate that are mounted adjacent to each other. A ramp is mounted adjacent the first and second plates so as to define a coin entry path between the two plates above the ramp. Coins can roll on their edge between the two plates along the ramp while leaning against one of the plates.

The second plate is mounted in a pivotable relationship with respect to the first plate so as to be able to move from a first position where the plates are essentially parallel to each other to a second position where they are not. There are also means for causing the second plate to pivot away from the first plate so as to cause the second plate to move from the first position to the second position.

In a preferred form the first plate is mounted to a face plate having a coin entry slot and the ramp is tilted sideways (at least when the second plate is in the second position). Also, the first plate has an opening for permitting insertion of a leg of a kicker therethrough upon swinging of said second plate from the first position towards said second position. The kicker can be rigidly mounted to the second plate.

In another aspect, when the second plate is in the first position, there is a gap above the ramp and through or below a plate.

A primary object of the invention is to provide a coin chute of the above kind which is easy to clean once foreign objects have jammed the coin entry.

Another objective of the present invention is to provide such a coin chute which is resistant to becoming clogged.

Still another object of the invention is to provide a coin chute of the above kind that does not allow fluid to pass through the coin entry to an electronic coin changer.

Yet another objective of the present invention is to provide a mechanism for use with such a coin chute to help urge blocking objects out of the coin entry path.

It is another object of the present invention to provide such a coin chute which is inexpensive to produce, easy to assemble, and easy to maintain and operate.

The foregoing and other objects and advantages of the invention will be apparent from the description which follows. In the description reference is made to the accompanying drawings which form a part hereof, and in which there is shown by way of illustration a preferred embodiment of the invention. However, it is to be understood that the invention is broader than merely the preferred embodiment.

BRIEF DESCRIPTION OF THE DRAWINGS

FIG. 3 is a cross sectional view taken along line 3—3 of the coin chute of FIG. 2;

FIG. 4 is a cross sectional view taken along line 3—3 of the coin chute of FIG. 2, with the backplate pivoted away from the main plate; and FIG. 5 is a sectional view along line 5—5 of the coin chute of FIG. 3.

DETAILED DESCRIPTION OF THE PREFERRED EMBODIMENTS

Figure 1:
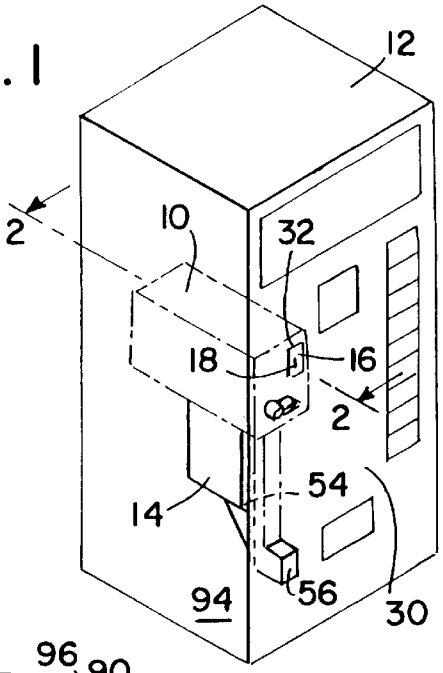
FIG. 1 is a perspective view of a vending machine incorporating the present invention.

As shown in FIG. 1 there is a coin chute 10 which is mounted on an inside wall 94 of vending machine 12 and disposed above a coin changer 14. The coin changer can be a conventional one, such as a Coinco Model No. 9302-GX, supplied by Coin Acceptors, Inc. of St. Louis, Mo.

When an appropriate coin 15 is inserted, the coin changer 14 receives the coin (see e.g. FIG. 5) after it successfully passes through the coin chute 10. When an inappropriate coin, or other inappropriate object, is inserted the coin chute rejects it in the manner described below into a coin return chute 54 that terminates at coin return slot 56 (the latter being accessible to a user).

Coin chute 10 has a face plate 16 having an entry slot 18 for receiving coins. As shown in FIGS. 2–5, there is also a main/first plate 20 that includes a ramp 22 mounted thereon. There is also a back/second plate 24. When the plates are in a generally parallel and adjacent relationship, the space above the ramp and between the plates constitutes a narrow coin guide path 23. There is also a kicker 26 that urges foreign objects off of the coin entry path 23 upon activation of a reject activator mechanism 28.

The face plate 16 is preferably a galvanized steel plate that is mounted to a front wall 30 of the vending machine 12. The coin entry slot 18 is exposed in the usual manner through an opening 32 in the vending machine.

Figure 2:
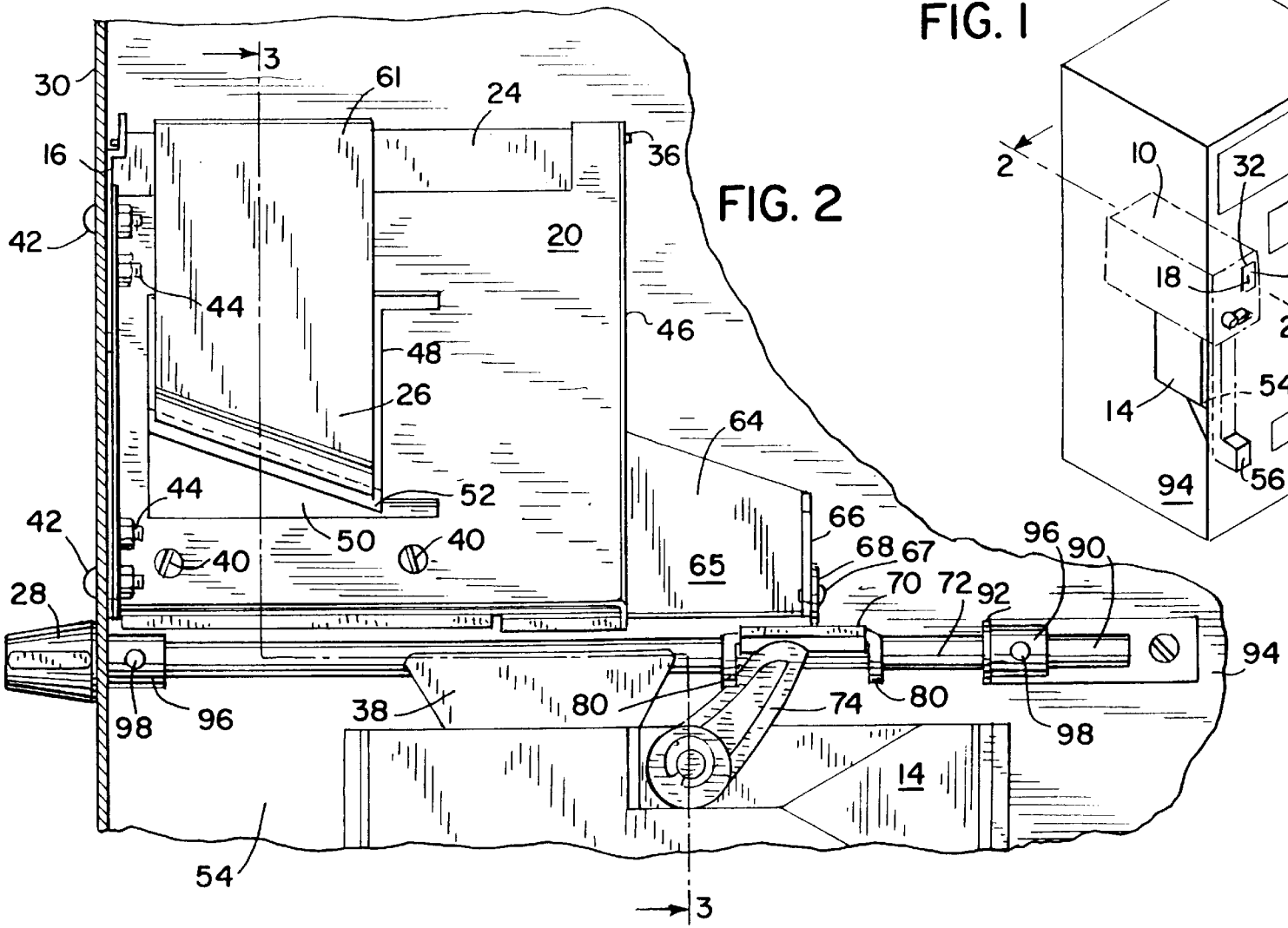
FIG. 2 is a side view of a coin chute of FIG. 1, taken along line 2—2.

As shown in FIGS. 2 and 5, a hole 34 formed in the plate 16 receives one end of a shaft 36 for pivotally mounting the backplate 24, and the main plate 20 is flange mounted to the face plate 16 by nut and bolt assemblies 42 that extend through the face plate for mounting the entire apparatus to the vending machine front wall.

Additional nut and bolt assemblies 44 secure the face plate 16 to the main plate 20 to facilitate assembly and installation. Although mounting the main plate 20 to the face plate 16 is preferred, the main plate 20 can be mounted directly to a vending machine wall 30 having a coin entry slot without departing from the scope of the invention.

An inward end plate 46 is generally perpendicular to the main plate 20 and forms an integral part thereof. It has a hole 35 that receives the other end of the shaft 36 for pivotally mounting the backplate 24.

A ramp 22 is mounted to the main plate 20 to help define a coin entry path 23 from the coin entry slot 18 to a coin receptacle 38 of the coin changer 14. The ramp 22 is preferably formed of a resilient plastic material such as a Ultra High Molecular Weight (UHMW), and is mounted to the main plate 20 by screws 40.

An opening 48 formed in the main plate 20 provides access for the kicker 26 that can dislodge objects on the ramp 22 in the event of a jam. The opening 48 is substantially covered by a transparent material 50, such as an acrylic or polycarbonate material, having a slot 52 formed along the coin entry path 23 suitable for insertion of the kicker 26. The transparent material 50 provides a window for a technician to see into the coin chute 10 when performing repairs or maintenance.

The backplate 24 is pivotally mounted on the shaft 36 supported on one end by the face plate 16 and the other end by the end plate 46. Importantly, the backplate 24 can swing away from the main plate 20 when reject lever 28 is actuated so as to allow an object on the coin entry path 23 to fall off of the ramp 22 into a coin return chute 54 that terminates in a coin return slot 56 (compare FIGS. 3 and 4).

The backplate 24 is preferably also formed from UHMW and is adapted to mesh with the ramp 22 in a slightly vertically overlapping relationship. There is therefore a slight side gap 58 (see FIG. 5) between the ramp 22 and the bottom of the backplate 24 to allow small objects or fluid to fall into the return chute 54 without further action by a user. In this regard, the plates are tilted to facilitate objects and fluid falling through the gap 58 and into the coin return chute 54 before reaching the coin changer 14. Alternatively, a hole could be provided through a plate adjacent the top of the ramp 22.

The kicker 26 is mounted on the backplate 24 by screws 60, and has a main portion 61 and a foot portion 62. The main portion 61 wraps over and in front of the main plate 20. The foot 62 is adapted for insertion through the slot 52 along the coin entry path 23.

A galvanized steel backplate extension 64 has a main portion 65 and a distal end 66 substantially perpendicular to the main portion 65. The main portion 65 is mounted on the backplate 24 by screws 69 and extends past the end plate 46 away from the vending machine front wall 30. A wheel 68 rotatably mounted by a rivet 67, or other methods known in the art, on the distal end 66 engages a shelf 70.

The shelf 70 is rigidly mounted on a rotatable metal rod 72 which simultaneously actuates the coin chute 10 and the coin changer 14 rejection function when the rod 72 rotates. The shelf 70 actuates the coin chute 10 by pivoting downward, thus allowing the backplate 24 to swing away (due to gravity) from the main plate 20. The shelf actuates the coin changer 14 rejection system by depressing the coin changer reject lever 74.

The shelf 70 has a mounting portion 76 and a flat portion 78. The mounting portion 76 has a pair of downwardly extending tabs 80 with holes 82 formed therein for inserting the rod 72 therethrough. A set screw 84 interposed between the tabs 80 secures the shelf 70 preventing slippage on the rod 72 in the axial or circumferential directions.

The shelf flat portion 78 extends radially from the rod 72 and has a top surface 86 and a bottom surface 88. The top surface 86 engages the backplate extension wheel 68 and the bottom surface 88 engages the coin changer reject lever 74. The length and width of the shelf flat portion 78 is adapted to accommodate the coin changer reject lever 74 and the backplate extension wheel 68.

The rod 72 has a first end (not shown) extending through the vending machine front wall 30 and a second end 90 extending through a bracket 92 mounted to a vending machine side wall 94. The coin reject lever 28 press fit on the first end of the rod 72 is operated by a user to actuate the coin chute 10 and the coin changer 14 reject function. Collars 96 mounted on the rod 72 with set screws 98 prevent the rod 72 from moving in the axial direction and being pulled out of the vending machine 10.

In normal use, a coin 15 is inserted into the coin slot 18. It then proceeds along the top of the ramp 22 to its inward end and falls into the coin changer receptacle 38. In the event an undesired object (e.g. a paper clip or wad of paper) becomes lodged inside the coin chute 10, the user can rotate the reject lever 28, lowering the shelf 70, which in turn allows the backplate 24 to swing away from the main plate 20 (due to gravity). The blocking object then falls off of the tilted ramp 22 and into the coin return chute 54.

Objects that do not fall freely off of the coin entry path 23 are aided by the kicker 26 that extends through the main plate slot 52 as the backplate 24 swings away to clear the coin entry path 23. Simultaneously, the shelf 70 depresses the coin changer reject lever 74, actuating the reject function of the coin changer 14. Return of the reject lever drives shelf 70 back to the FIG. 3 position, and thereby restores the backplate to the FIG. 3 position.

If small objects (e.g. small slugs) or fluid are inserted in coin slot 18, they will pass out gap 58 even without the use of the reject lever 28. This helps reduce the incidence of jams occurring which require the use of the reject lever.

What has been described above is merely the preferred embodiment of the invention. Various changes and modifications can be made therein without departing from the scope of the invention defined by the appended claims.

INDUSTRIAL APPLICABILITY

The invention provides equipment for use in connection with vending machines to minimize jamming in the coin entry chute.

I claim:

1. A coin chute for use with a vending machine, comprising:

a first plate;

a second plate mounted adjacent the first plate;

a ramp mounted adjacent the first and second plates so as to define a coin entry path between the two plates above the ramp;

the second plate being mounted in a pivotable relationship with respect to the first plate so as to be able to move from a first position where the plates are essentially parallel to each other to a second position where they are not, wherein when the second plate is in the first position, there is a gap above the ramp and through or below a plate, and both plates are tilted sideways toward said gap;

a kicker, the kicker being mounted to said second plate for pivotable movement therewith, wherein pivoting of said second plate from said first position to said second position causes a portion of said kicker to pivot through said gap; and means for causing the second plate to pivot away from the first plate so as to cause the second plate to move from the first position to the second position to assist in the clearing of an object in the coin entry path if there is a foreign object in the coin entry path.

2. A coin chute as in claim 1, wherein the first plate is mounted to a face plate having a coin entry slot.

* * * * *